US005307032A

United States Patent [19]

Uno

[11] Patent Number: 5,307,032

[45] Date of Patent: Apr. 26, 1994

[54] WIDEBAND FREQUENCY DISTRIBUTED SIGNAL SELECTOR USING ELECTROMAGNETIC COUPLING

[75] Inventor: Tsuyomasa Uno, Atsugi, Japan

[73] Assignee: Anritsu Corporation, Tokyo, Japan

[21] Appl. No.: 952,530

[22] PCT Filed: Mar. 23, 1992

[86] PCT No.: PCT/JP92/00350

§ 371 Date: Nov. 30, 1992

§ 102(e) Date: Nov. 30, 1992

[87] PCT Pub. No.: WO92/17912

PCT Pub. Date: Oct. 15, 1992

[30] Foreign Application Priority Data

Mar. 29, 1991 [JP] Japan ..... 3-92806

[51] Int. Cl.[5] ..... H01P 1/10; H01P 1/15

[52] U.S. Cl. ..... 333/101; 333/103; 333/109

[58] Field of Search ..... 333/101, 103-105, 333/109, 112, 115, 116

[56] References Cited

U.S. PATENT DOCUMENTS

| | | | |
|---|---|---|---|
| 3,559,108 | 1/1971 | Seidel | 333/103 |
| 3,571,765 | 3/1971 | Friedman | 333/103 X |
| 4,004,257 | 1/1977 | Geissler . | |
| 4,450,422 | 5/1984 | Lockwood | 333/202 |
| 4,985,689 | 1/1991 | Kadowaki et al. | 333/101 |

FOREIGN PATENT DOCUMENTS

| | | |
|---|---|---|
| 35-1862 | 3/1960 | Japan . |
| 62-13101 | 1/1987 | Japan . |
| WO88/00760 | 1/1988 | PCT Int'l Appl. . |
| 231643 | 5/1969 | U.S.S.R. . |

OTHER PUBLICATIONS

IBM Technical Disclosure Bulletin; H. R. Foglia "Transmission Line Transformer Load Sharing Switch"; vol. 7, No. 6, Nov., 1964; p. 466.

Soviet Inventions Illustrated; Derwent Publicaions Ltd., London, G.B., Class WO2, AN 86-278018/42 & SU-A-1220031 (Petrenko) Mar. 23, 1986. Abstract.

"An X-Band 12W GaAs Monolithic Transmit-Receive Switch", M. Matsunaga et al, The Transactions of the IEICE, vol. E70, No. 4, Apr. 1987, pp. 259-260.

*Primary Examiner*—Paul Gensler

*Attorney, Agent, or Firm*—Frishauf, Holtz, Goodman & Woodward

[57] ABSTRACT

According to the present invention, there is provided a signal selector using a distributed coupled line with a small signal distortion in a range from a low-frequency wave to a high-frequency wave. One end of a main transmission line is a common terminal, and the other end is a signal selecting terminal. A coupled transmission line has at least one signal selecting terminal, and the coupled transmission line comprises one or a plurality of coupled transmission lines coupled to the main transmission line by an electric field, a magnetic field, or both the electric and magnetic fields. Switches are respectively arranged between the signal selecting terminal and ground or between ground and the signal selecting terminal and between ground and the other end of the main transmission line so as to be selectively ON/-OFF-operated.

9 Claims, 14 Drawing Sheets

Zoo = 25Ω Zoe = 1,000Ω θ = 90deg ( AT 10 GHz )

□——□ ①←→② TRANSMISSION CHARACTERISTICS (SW2 : ON)

+——+ ①←→③ TRANSMISSION CHARACTERISTICS (SW1 : ON)

Zoo = 10.891Ω Zoe = 17.9Ω θ = 90deg ( AT 20 GHz )

□——□ ①←→② TRANSMISSION CHARACTERISTICS (SW2,SW3:ON)

+——+ ①←→③ TRANSMISSION CHARACTERISTICS (SW1,SW3:ON)

◇——◇ ①←→④ TRANSMISSION CHARACTERISTICS (SW1,SW2:ON)

Zoo=12.5Ω Zoe=500Ω θ=90deg ( AT 20GHz )

□——□ ①←→② TRANSMISSION CHARACTERISTICS (SW2 : ON)

+——+ ①←→③ TRANSMISSION CHARACTERISTICS (SW1 : ON)

Zoo=23Ω Zoe=108Ω θ=90deg ( AT 10 GHz )

□——□ ①←→② TRANSMISSION CHARACTERISTICS (SW2:ON)

+——+ ①←→③ TRANSMISSION CHARACTERISTICS (SW1:ON)

WIDEBAND FREQUENCY DISTRIBUTED SIGNAL SELECTOR USING ELECTROMAGNETIC COUPLING

DESCRIPTION

1. Field of the Invention

The present invention relates to a signal selector and, more particularly, to a signal selector using a distributed coupled line obtained by electromagnetic coupling to be able to perform selective transmission with a small signal distortion in a wideband ranging from a low frequency wave to a high-frequency wave.

2. Description of the Related Art

As a conventional signal switch used in a wideband ranging from a DC band to a microwave band, a mechanical switch has been mainly used. However, as in a case wherein a circuit is switched in accordance with sweeping, a large number of continuous switching operations pose a problem on the service life of a switching contact. In addition, although a switch using a semiconductor element is known, a capacitor for isolating a signal line from a control bias line must be inserted in series in the signal line, and a switching operation from a low-frequency band (band close to a DC having about 100 Hz) to a microwave band is difficult.

On the other hand, in a wideband spectrum analyzer, a switch arranged by incorporating a diode in a YTF (variable tuning filter using a YIG resonator) disclosed in U.S. Pat. No. 4,450,422 is used, thereby realizing wideband sweeping including a switching operation. However, since this switch has an arrangement requiring a tuning operation, it is difficult to apply this switch to equipment in other fields, such as a signal generator.

The arrangement of a conventional signal selector in which a capacitor and a diode are inserted in a signal line is shown in FIG. 21, and the equivalent circuit of the signal selector is shown in FIG. 22. The prior art will be described below with reference to FIGS. 21 and 22.

An AC input signal is supplied to a terminal A, and is supplied to the anodes of diodes D1 and D3 through a DC blocking capacitor C1. When the AC input signal is to be switched to a terminal B side, a negative bias voltage is applied to a terminal D, and a positive bias voltage is applied to a terminal E. In this manner, the diode D1 is forward-biased to be turned on, and a diode D2 is reverse-biased to be turned off. As a result, a closed path is formed between the terminals A and B, and the AC input signal is supplied to the terminal B. On the other hand, the diode D3 is reverse-biased to be turned off. In addition, a diode D4 is forward-biased to be turned on. As a result, the terminal A is disconnected from a terminal C, and the input signal is not supplied to the terminal C.

Since the diodes D1 to D4 serve as switches, they can be expressed in an AC form by an equivalent circuit shown in FIG. 22. That is, the diodes D1, D2, D3, and D4 correspond to switches S1, S2, S3, and S4, respectively.

On the other hand, when the AC input signal is to be switched to the terminal C side, in contrast to the above description, a positive bias voltage is applied to the terminal D, and a negative bias voltage is applied to the terminal E. In this manner, the diode D3 is forward-biased to be turned on, and the diode D4 is reverse-biased to be turned off. As a result, a closed path is formed between the terminals A and C, and the AC input signal is supplied to the terminal C. On the other hand, the diode D1 is reverse-biased to be turned off. The diode D2 is forward-biased to be turned on. As a result, the terminal A is disconnected from the terminal B, and the AC input signal is not supplied to the terminal B.

In the equivalent circuit used in this case, in contrast to the states of the switches shown in FIG. 22, the switches S1 and S4 are set in an open state, and the switches S3 and S2 are set in an ON state.

Note that the capacitor C1 and capacitors C2 and C3 in FIG. 21 are arranged to block a DC bias voltage so as to prevent loads or signal sources connected to the terminals A, B, and C from the influence of the DC bias voltage for ON/OFF-controlling the diodes. Resistors R1 to R3 are arranged to assure a path for a DC bias current, to keep a high impedance between a path through which the signal passes and a bias voltage source, and to isolate the path from the bias voltage source.

As the diodes serving as the switches, a normal diode is used in a low-frequency signal selector, and a PIN diode is used in a high-frequency signal selector. When the PIN diode is forward-biased, it has the characteristics of a linear resistor in a frequency band of about 10 MHz or more. The resistance of the resistor is expressed as a function of a bias voltage (or current). In this case, the linear resistor means that its resistance is not changed by an input signal. The PIN diode has the same nonlinear characteristics as those of the normal diode in a frequency band of about 10 MHz or less. In this case, the resistance is changed by the magnitude of the voltage of an AC input signal, thereby causing a signal distortion.

Therefore, the above prior art has the following drawbacks.

(1) A signal distortion occurs because diodes (D1 and D3) serving as nonlinear elements are inserted in series in a path through which a signal passes.

(2) Even when a PIN diode is used, a signal distortion occurs because a PIN diode has nonlinear characteristics in a frequency band of about 10 MHz or less.

(3) A signal having a DC band cannot be transmitted because the DC blocking capacitors (C1 to C3) are inserted in series in a path through which a signal passes.

SUMMARY OF THE INVENTION

It is, therefore, an object of the present invention to provide a wideband frequency distributed signal selector capable of selecting a signal in a wideband including a DC band to a microwave band without any signal distortion.

According one aspect of the present invention, there is provided a signal selector comprising:

a main transmission line having one common terminal;

one or a plurality of coupled transmission lines having at least one signal selecting terminal and coupled to the main transmission line by an electric field, a magnetic field, or both the electric and magnetic fields; and a plurality of conducting means which are respectively connected between the signal selecting terminal and ground or between ground and the signal selecting terminal and between ground and the other end of the main transmission line and can be selectively ON/OFF-operated.

That is, according to the present invention, in order to provide a signal selector capable of solving the problems of the prior art, the distributed coupled line constituted by the main transmission line and one or the plurality of coupled transmission lines coupled to the main transmission line by the electric field, the magnetic field, or both the electric and magnetic fields is arranged, and the conducting means which can be selectively ON/OFF-operated is arranged between one end of a desired transmission line and ground.

With the above arrangement, in a signal selector using both the electric field and the magnetic field, a signal to be selectively transmitted is input to the common terminal. One end of each of the coupled transmission lines is grounded. Since the coupled transmission lines are coupled to the main transmission line by the electric field, the magnetic field, or both the electric and magnetic fields, the signal input to the common end is induced to each of the coupled transmission lines.

In the above state, when only one of the plurality of conducting means corresponding to a signal selecting terminal to which a signal is to be transmitted is turned off, and the remaining conducting means are turned on, the signal can be transmitted to a desired signal selecting terminal.

That is, according to the present invention, an input signal is branched into a main transmission line and a coupled transmission line in accordance with frequency bands in a distributed coupled line obtained by electromagnetic coupling, and the branched signals are selected by a plurality of conducting means arranged between each line and ground. Therefore, when a coupled transmission line is selected, a signal in a high-frequency band is output. When the main transmission line is selected, a signal ranging from a DC band to a high-frequency band is output. With the above arrangement, a wideband frequency distributed signal selector can be realized.

Note that, when the signal selector is used such that its input and output are reversed to each other, it can also be used as a signal synthesizer.

BRIEF DESCRIPTION OF THE DRAWINGS

FIGS. 11A and 11B are a graph showing transmission characteristics and a view showing a conditional circuit of the transmission characteristics, respectively, in which FIG. 11A is a graph showing transmission characteristics obtained by the simulation of the first application example and FIG. 11B is a view showing the conditions of the first application example;

FIGS. 12A and 12B are a graph showing transmission characteristics and a view showing a conditional circuit of the transmission characteristics, respectively, in which FIG. 12A is a graph showing transmission characteristics obtained by the simulation of the second application example and FIG. 12B is a view showing the conditions of the second application example;

FIGS. 13A and 13B are a graph showing transmission characteristics and a view showing a conditional circuit of the transmission characteristics, respectively, in which FIG. 13A is a graph showing transmission characteristics obtained by the simulation of the third application example and FIG. 13B is a view showing the conditions of the third application example;

FIGS. 14A and 14B are a graph showing transmission characteristics and a view showing a conditional circuit of the transmission characteristics, respectively, in which FIG. 14A is a graph showing transmission characteristics obtained by the simulation of the fourth application example and FIG. 14B is a view showing the conditions of the fourth application example;

FIGS. 15A and 15B are a graph showing transmission characteristics and a view showing a conditional circuit of the transmission characteristics, respectively, in which FIG. 15A is a graph showing transmission characteristics obtained by the simulation of the fifth application example and FIG. 15B is a view showing the conditions of the fifth application example;

FIGS. 16A and 16B are views showing an arrangement of another embodiment of a signal selector according to the present invention, in which FIG. 16A is a sectional view showing the signal selector along a line perpendicular to the axis of the longitudinal direction of the signal selector and FIG. 16B is a sectional view showing the signal selector along a line parallel to the axis of the longitudinal direction of the signal selector;

FIGS. 18A to 18E are views showing detailed examples of the signal selector shown in FIGS. 16A and 16B, in which FIG. 18A is a bottom view showing the signal selector when the lower lid of a case is removed, FIG. 18B is an enlarged view showing a part extracted from the signal selector in FIG. 18A, FIG. 18C is a side view, FIG. 18D is a sectional view, and FIG. 18E is a wiring diagram FIGS. 19A and 19B are a graph showing the transmission characteristics of the signal selector shown in FIGS. 18A to 18E and a view showing a conditional circuit of the transmission characteristics, in which FIG. 19A is a graph showing transmission characteristics obtained by actual measurement and FIG. 19B is a view showing the conditions of FIG. 19A;

DETAILED DESCRIPTION OF THE PREFERRED EMBODIMENT

An embodiment of the present invention will be described below with reference to the accompanying drawings.

(Arrangement)

Figure 1:
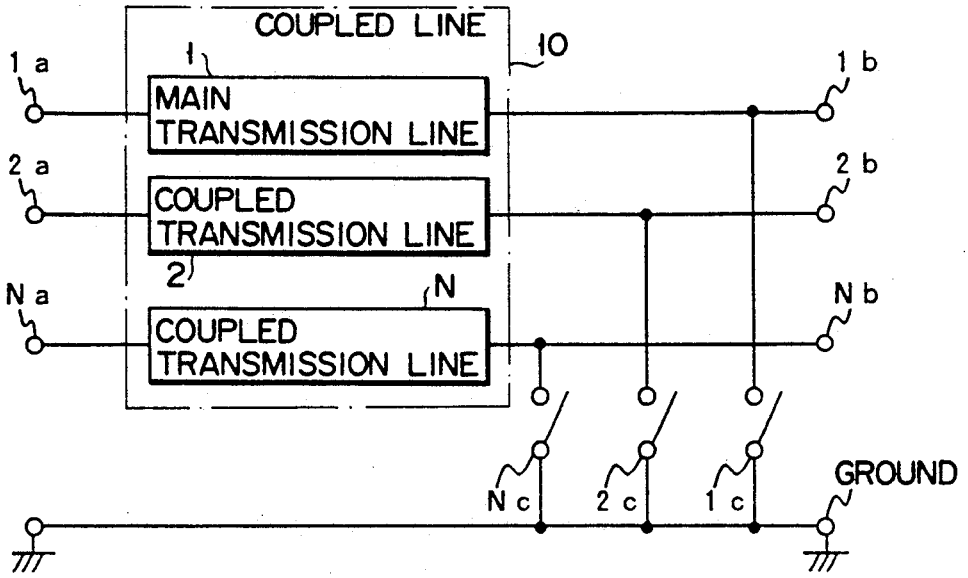
FIG. 1 is a view showing an arrangement of one embodiment of a signal selector according to the present invention.

FIG. 1 is a view showing an arrangement of an embodiment of a signal selector according to the present invention.

As shown in FIG. 1, a common terminal 1*a* is provided at one end of a main transmission line 1, and a signal selecting terminal 1*b* is provided at the other end thereof. A plurality of coupled transmission lines 2 to N are coupled to the main transmission line 1 by an electric field, a magnetic field or both the electric and magnetic fields. One end (2*a* to Na) and each of signal selecting terminals 2*b* to Nb are provided at a corresponding one of the coupled transmission lines 2 to N. In the above arrangement, the main transmission line 1 and the coupled transmission lines 2 to N constitute a coupled line 10. In addition, a plurality of conducting means 1*c*, 2*c*,. . . , Nc which can be opened are arranged between ground and the signal selecting terminals 1*b*, 2*b*, . . . , Nb, respectively.

(Function)

A function of the signal selector arranged as described above will be described below with reference to FIG. 2.

A signal source 11 which outputs a signal to be selected is connected to the common terminal 1*a*. One end (2*a* to Na) of each of the coupled transmission lines 2 to N is grounded. Since the coupled transmission lines 2 to N are coupled to the main transmission line 1 by an electric field, a magnetic field, or both the electric and magnetic fields, an input signal supplied from the signal source 11 to the common terminal 1*a* is induced to each of the coupled transmission lines 2 to N.

In this case, when the conducting means 1*c* is open, and the conducting means 2*c* to Nc are closed, a signal appears at the signal selecting terminal 1*b*, but no signal appears at the signal selecting terminals 2*b* to Nb.

In addition, when desired ones of the conducting means 2*c* to Nc are open (e.g., the means 2*c* is open), and all the remaining conducting means are closed (e.g., the conducting means other than the means 2*c* are closed), a signal appears at the signal selecting terminal (e.g., 2*b*) corresponding to the conducting means (e.g., 2*c*) which is open, but no signal appears at the remaining signal selecting terminals.

That is, when only a conducting means corresponding to a signal selecting terminal to which a signal is to be transmitted is open, and the remaining conducting means are closed, the signal can be transmitted to a desired signal selecting terminal. (Detailed Description of Conducting Means)

Figure 2:
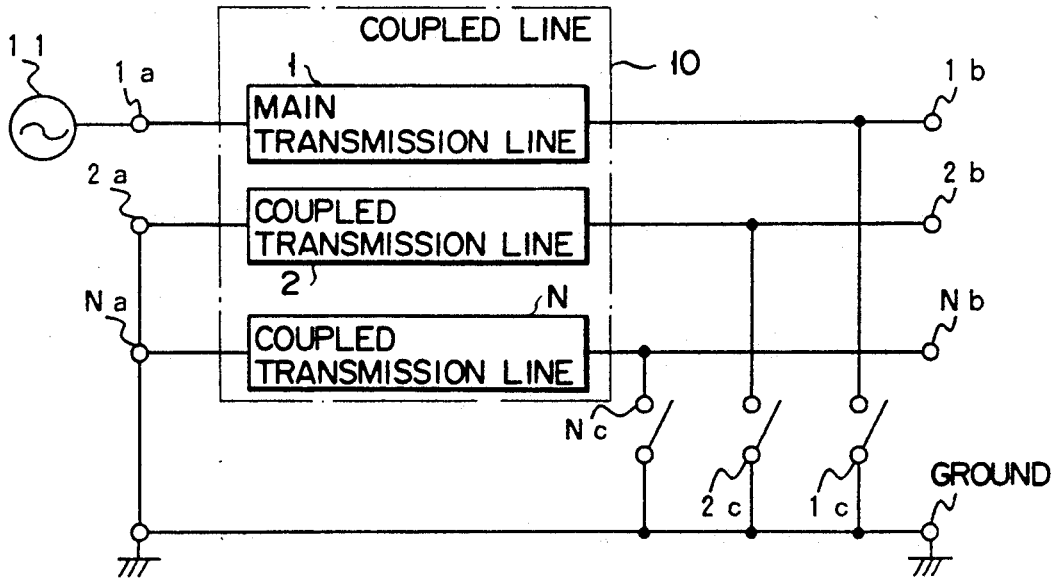
FIG. 2 is a view showing another arrangement of the signal selector of the present invention to explain the function of FIG. 1.

Switches, relays, and the like each having a mechanical contact can be used as the conducting means 1*c* to Nc in FIG. 2 when switching repetition does not pose any problem on service life. However, when high-speed repetitive switching operations must be performed, a conducting means using a semiconductor element is effectively used. The conducting means using the semiconductor element will be described below with reference to FIGS. 3 and 4.

Figure 3:
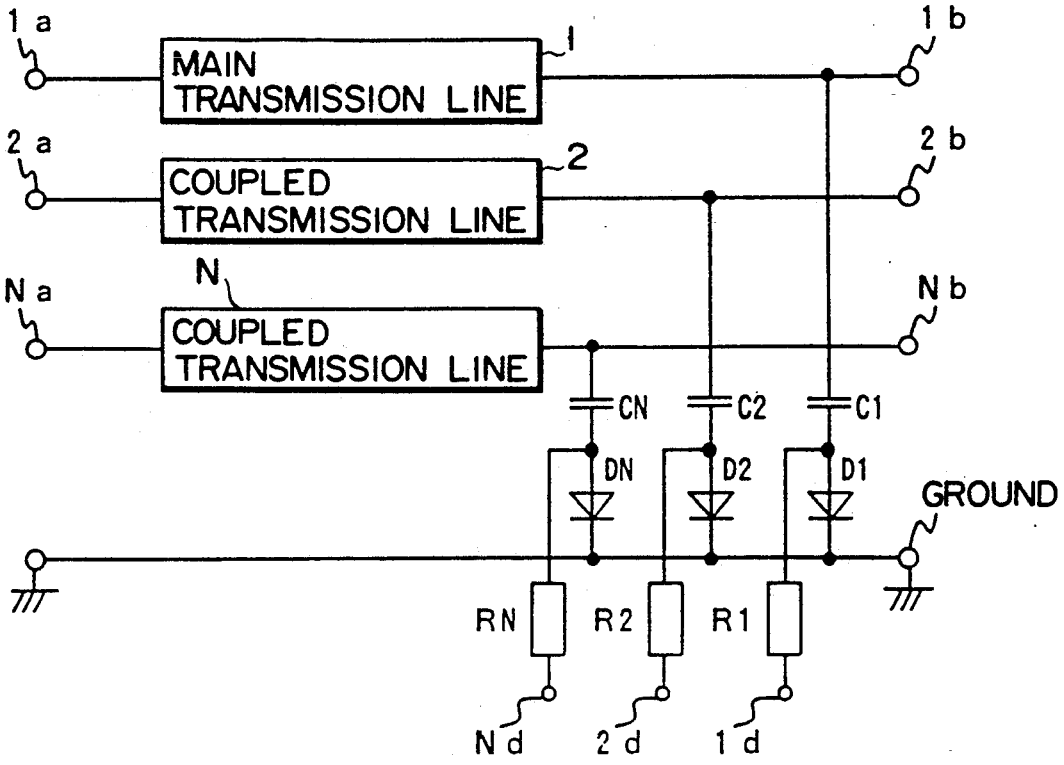
FIG. 3 is a view showing an arrangement of a detailed example of a plurality of conducting means in FIG. 1.

In FIG. 3, each of capacitors C1 to CN and each of diodes (e.g., PIN diodes) D1 to DN are connected in series between ground and a corresponding one of the signal selecting terminals 1*b* to Nb, and one end of each of resistors R1 to RN is connected to a corresponding one of the connection points between the capacitors and the diodes. The other end of each of the resistors is connected to a corresponding one of control terminals 1*d* to Nd.

In the conducting means arranged as described above, when a negative bias voltage is applied to the control terminal 1*d*, and a positive bias voltage is applied to the control terminals 2*d* to Nd, the diode D1 is negatively biased to be turned off. That is, an open state is set between the signal selecting end 1*b* and ground, and the signal supplied to the common end 1*a* appears at the signal selecting end 1*b*.

The diodes D2 to DN are positively biased to be turned on. That is, the signal selecting terminals 2*b* to Nb are short-circuited to ground, and no signal appears at the signal selecting terminals 2*b* to Nb.

As described above, a negative bias voltage is applied to the control terminal of a conducting means corresponding to a signal selecting terminal from which a signal is to be extracted, and a positive bias voltage is applied to the control terminals of conducting means corresponding to the remaining signal selecting terminals.

The capacitors C1 to CN are arranged to block the DC bias voltage so as to prevent the loads or signal sources connected to the common terminal 1*a* or the signal selecting terminals 1*b* to Nb from the influence of the DC bias voltage for ON/OFF-controlling the diodes. In addition, the resistors R1 to RN are arranged to keep a high impedance between a path through which a signal passes and a bias voltage source and to isolate the path from the bias voltage source.

Figure 4:
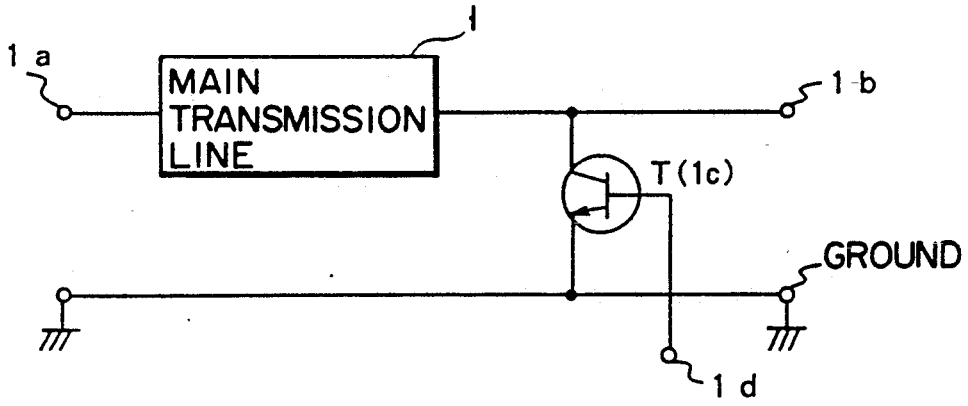
FIG. 4 is a view showing an arrangement of a main part of another detailed example of the conducting means in FIG. 1.

FIG. 4 is a view showing an arrangement of an example of the conducting means 1*c* using a transistor. In FIG. 4, although only the main transmission line 1 and the conducting means 1*c* corresponding thereto are extracted and simplified, each of the remaining coupled transmission lines 2 to N has the same arrangement as that of the main transmission line 1.

The collector, emitter, and base of a transistor T are connected to the signal selecting terminal 1*b*, ground, and the control terminal 1*d*, respectively. When a positive bias voltage is applied to the control terminal 1*d*, the signal selecting terminal 1*b* is short-circuited to ground, and no signal appears at the signal selecting terminal 1*b*. In addition, when a negative bias voltage is applied to the control terminal 1*d*, the signal selecting terminal 1*b* is disconnected from ground, and a signal appears at the signal selecting terminal 1*b*.

When the transistor T is operated in a saturation state, since the collector-emitter path exhibits a pure resistance behavior, the transistor T can be used as a switch regardless of a DC closed path. For this reason, it can be properly selected in a design to interpose a capacitor between the signal selecting terminal 1*b* and the collector of the transistor T.

As described above, since no nonlinear element such as a diode is interposed in the main transmission path 1 and the coupled transmission lines 2 to N, a selectively transmitted signal has no distortion.

In addition, since a DC blocking capacitor is not interposed in the main transmission line 1, a signal having a DC band can be transmitted between the common end 1*a* and the signal selecting terminal 1*b*. As a conducting means used in this case, the conducting means using the transistor T shown in FIG. 4 is effectively used.

Since the main transmission line 1 is coupled to each of the coupled transmission lines 2 to N by an electric field, a magnetic field, or both the electric and magnetic fields, a signal having a DC band cannot be transmitted to the coupled transmission lines 2 to N.

(Embodiment Having One Coupled Transmission Line)

Figure 5:
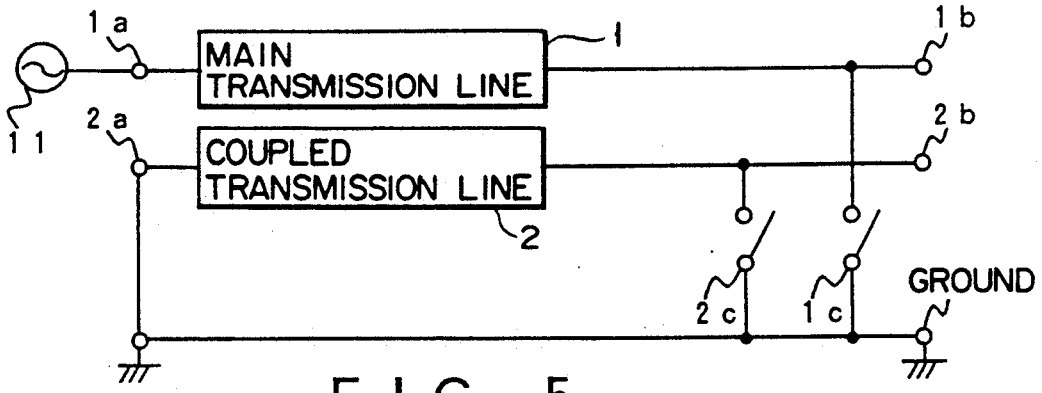
FIG. 5 is a view showing an application example of a signal selector according to the present invention.

FIG. 5 is a view showing the arrangement of an embodiment having one coupled transmission line. In this embodiment, a signal 11 is switched to any one of signal selecting terminals 1*b* and 2*b*.

(Embodiment Using Reversibility)

Figure 6:
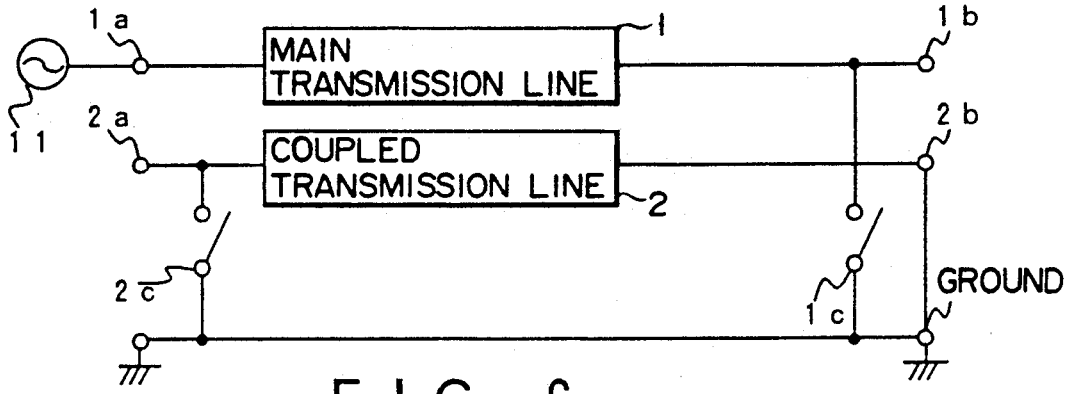
FIG. 6 is a view showing another application example of the signal selector according to the present invention.

Each of the above embodiments (FIGS. 1 to 5) exemplifies that in the coupled line 10 constituted by one coupled transmission line and one or a plurality of transmission lines 2 to N, the signal selecting terminal (2*b* to Nb) arranged in the coupled transmission line (2 to N) is connected to one end which is distant from the common terminal la of the main transmission line 1. However, as shown in FIG. 6, even when a signal selecting terminal 2*a* (to Na) of a coupled transmission line 2 (to N) is arranged at an end close to a common terminal 1*a*, the same function and effect as described above can be obtained. In this case, one terminal 2*b* (to Nb) side is grounded. Also, the conducting means 2*c* is connected between the signal selecting terminal 2*a* (to Na) and ground. Namely, when the conducting means 1*c* is closed and the conducting means 2*c* is open, a signal is output from the signal selecting terminal 2*a* ) (to Na).

(Embodiment Using Electromagnetically Coupled Transformer)

Figure 7:
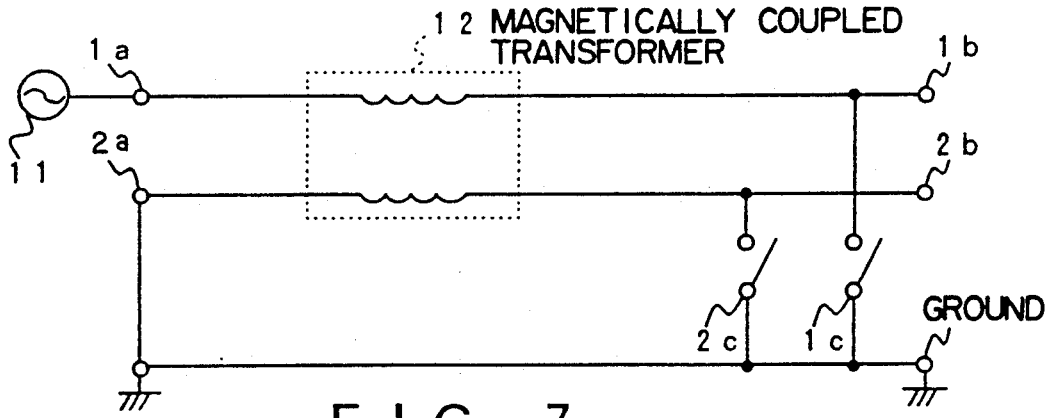
FIG. 7 is a view showing an arrangement of a signal selector constituted by transmission lines using a magnetically coupled transformer.

In addition, in a signal switch unit using a coupled line constituted by a main transmission line and a coupled transmission line described in the above embodiments, even when a transformer 12 coupled by only a magnetic field is used, as shown in FIG. 7, the same function and effect as described above can be obtained.

(Embodiment Using Electromagnetic Coupling)

Figure 8:
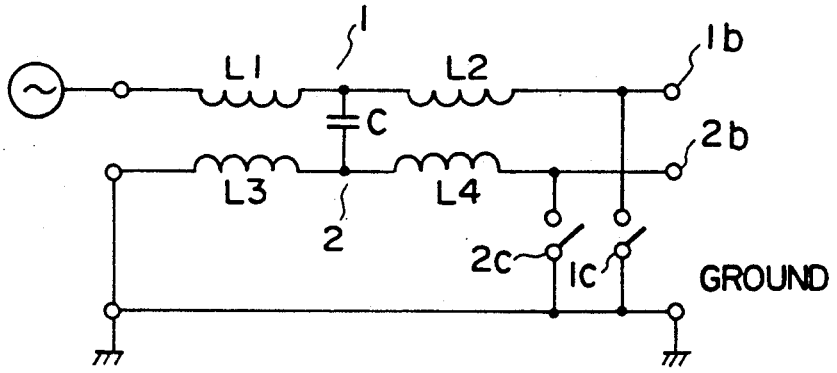
FIG. 8 is a view showing an arrangement of an embodiment using electric coupling.

As shown in FIG. 8, when a capacitor C is interposed between a main transmission line 1 and a coupled transmission line 2, and both the transmission lines 1 and 2 are coupled to each other by only an electric field, the same function and effect as described above can be obtained. Note that each of inductances L1 to L4 is a self-inductance component of each of the lines which are not coupled to each other or a component obtained by an inductor inserted to compensate for frequency characteristics (will be described later).

(Description of Coupled Line)

Figure 9:
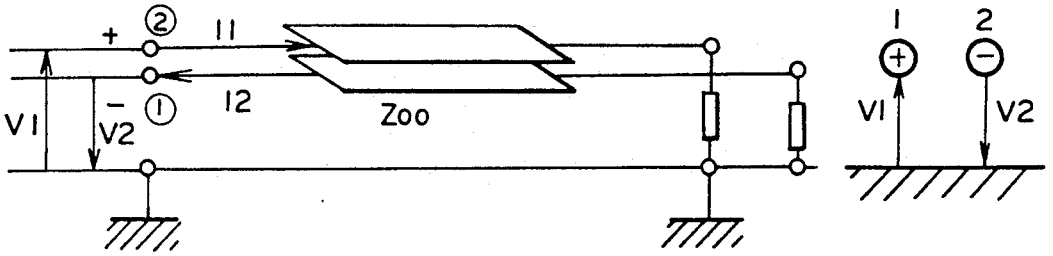
FIG. 9 is a view for explaining an odd-mode characteristic impedance of a coupled line.

A coupled line will be described below in detail. FIG. 9 is a view for explaining an odd-mode characteristic impedance of the coupled line, and FIG. 10 is a view for explaining an even-mode characteristic impedance.

The odd-mode characteristic impedance is a characteristic impedance obtained when transmission is performed such that a terminal 1 (forward path) and a terminal 2 (return path) have the same current and different phases which are shifted from each other by 180°.

Figure 10:
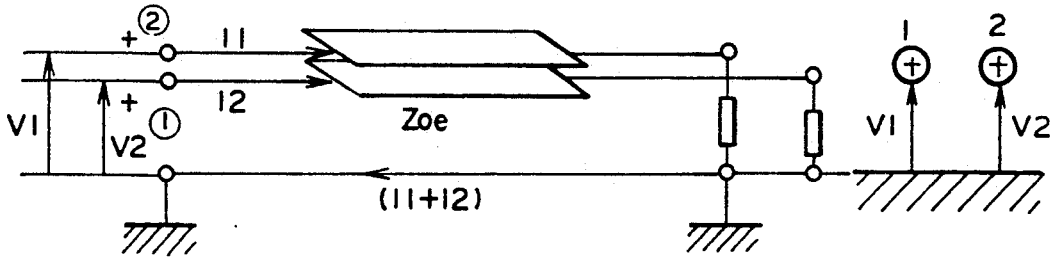
FIG. 10 is a view for explaining an even-mode characteristic impedance of the coupled line.

The even-mode characteristic impedance is, as shown in FIG. 10, a characteristic impedance obtained when transmission is performed such that the potentials of both the lines are set to be equal to each other and that ground is used as a return path, i.e., a characteristic impedance (measured when in-phase voltages are applied to the terminals 1 and 2).

When the characteristic impedance ($Z_0$) of the coupled line, an odd-mode characteristic impedance ($Z_{00}$), and an even-mode characteristic impedance ($Z_{oe}$) are properly selected, wideband transmission characteristics required for a signal selector can be realized.

Figure 11A:
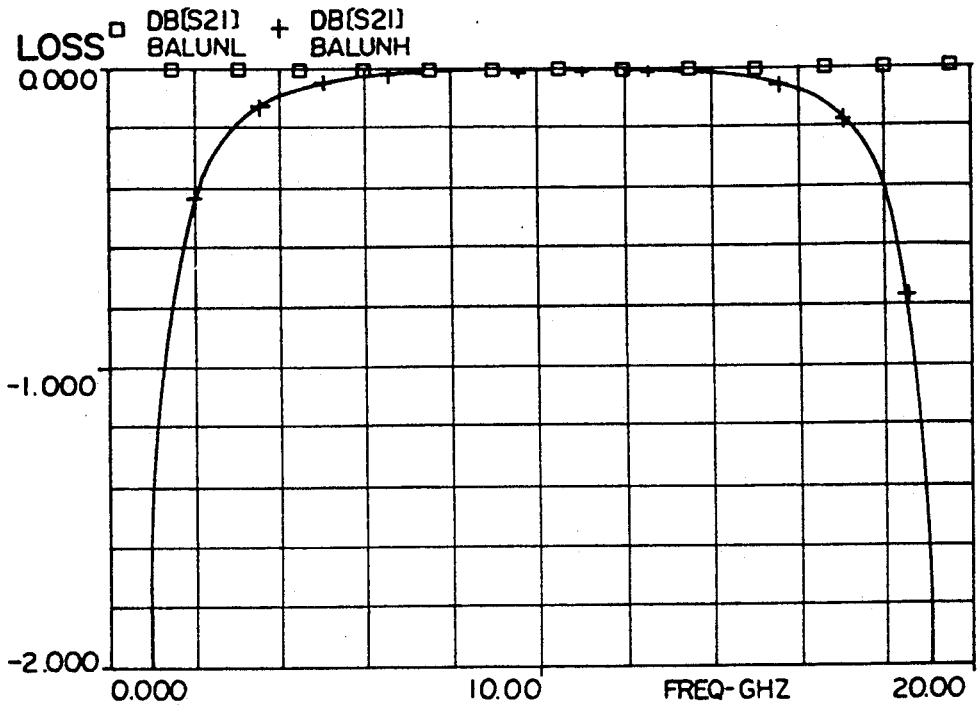
Figure 11B:
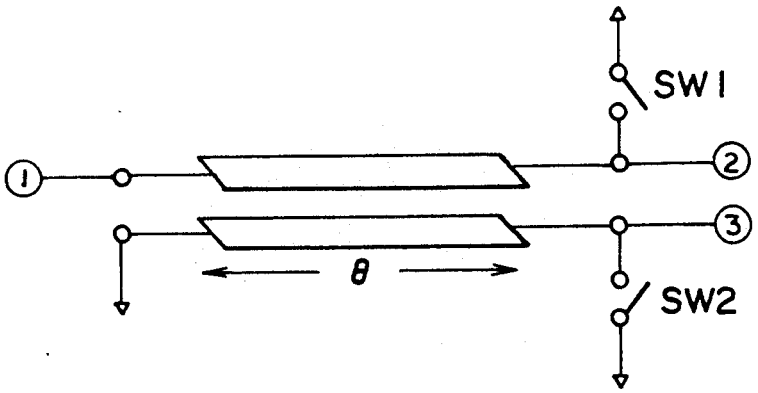
Figure 12A:
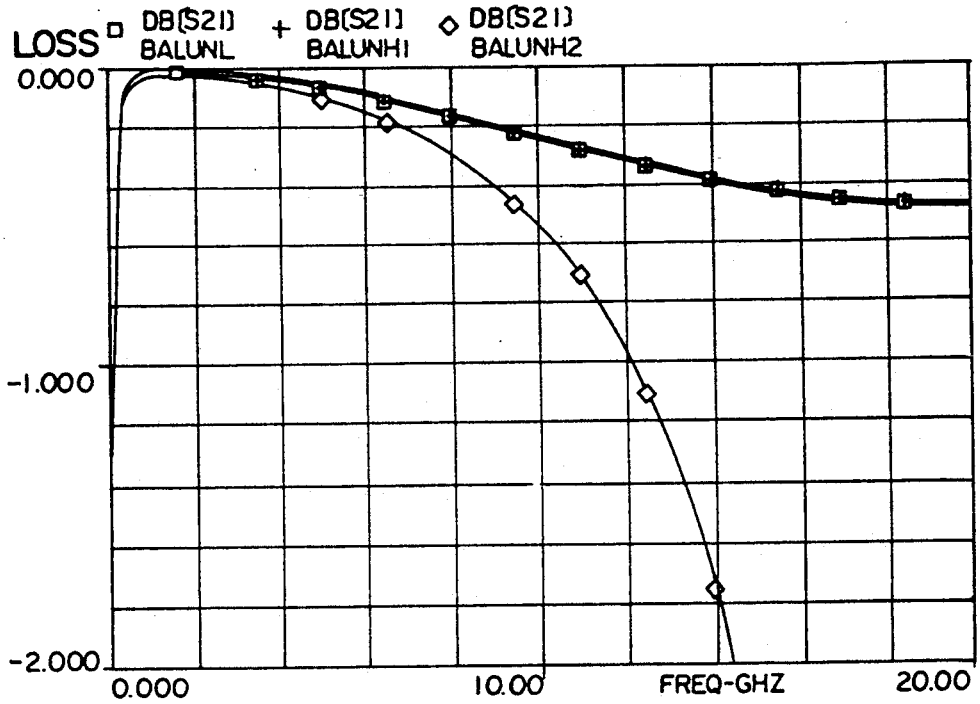
Figure 12B:
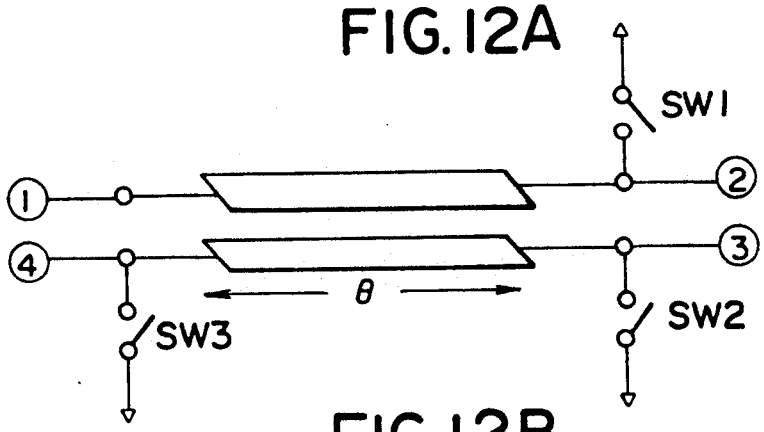
Figure 13A:
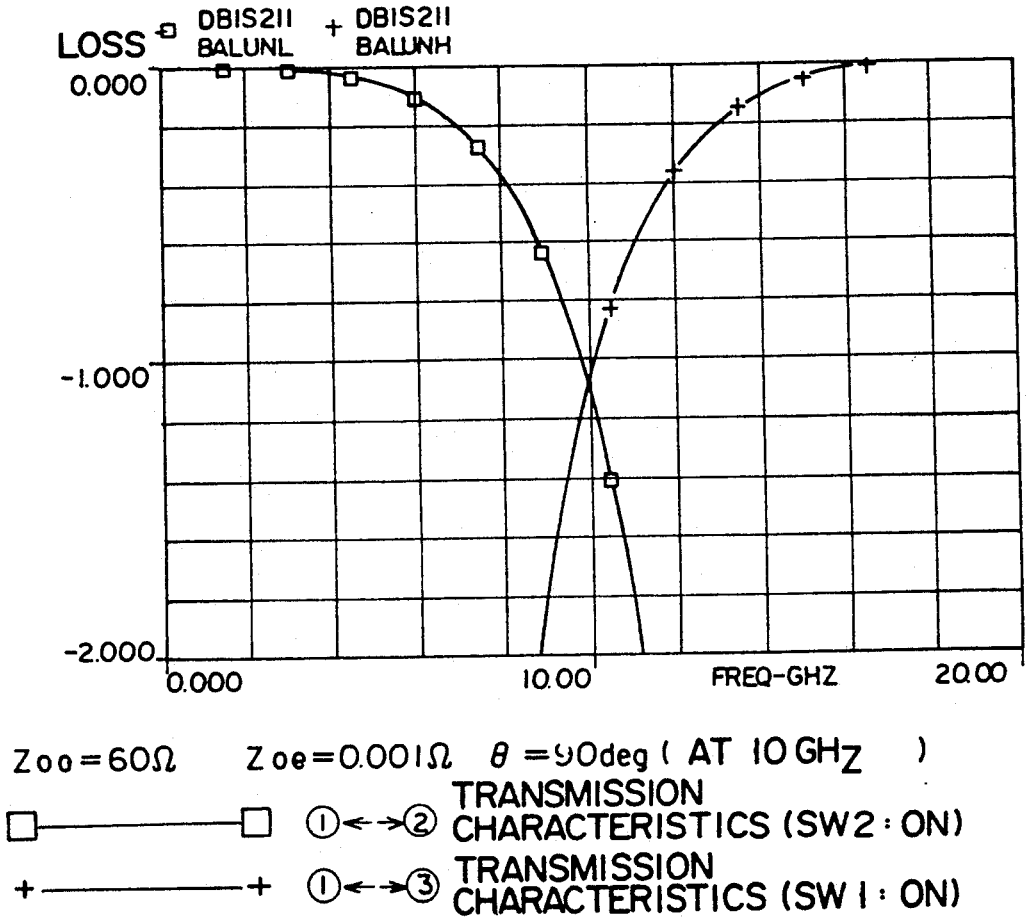
Figure 13B:
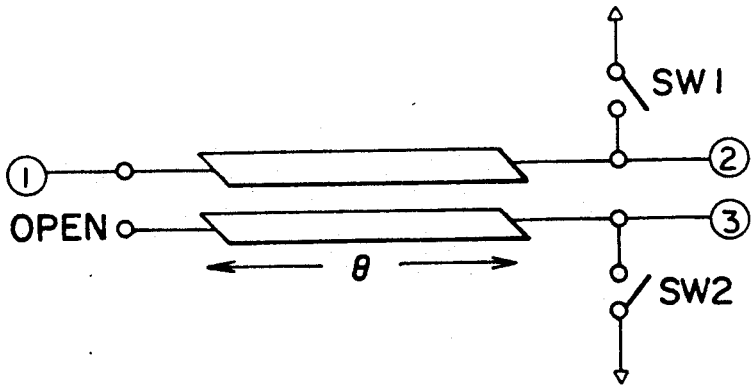
Figure 14A:
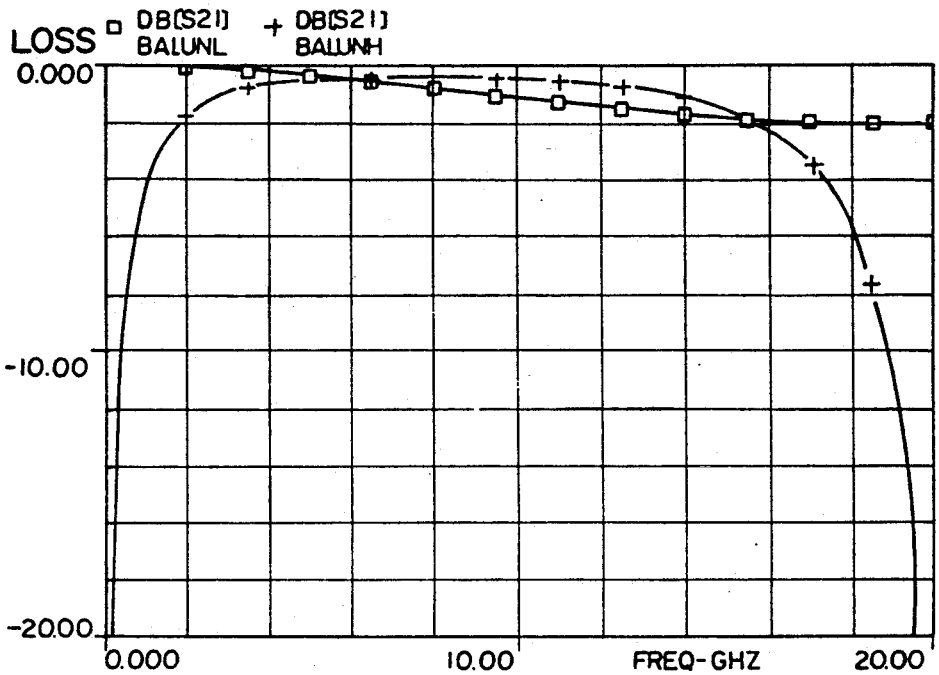
Figure 14B:
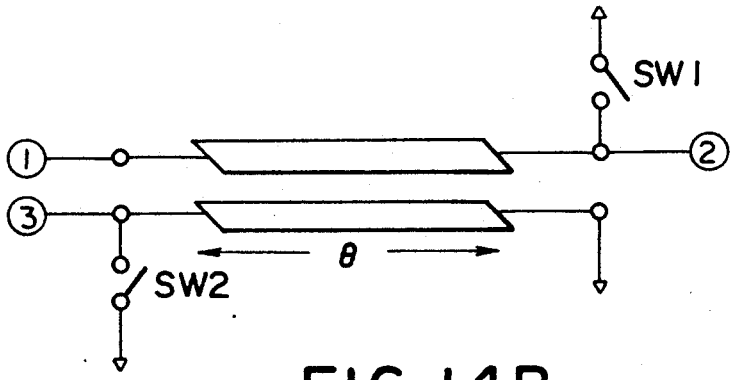
Figure 15A:
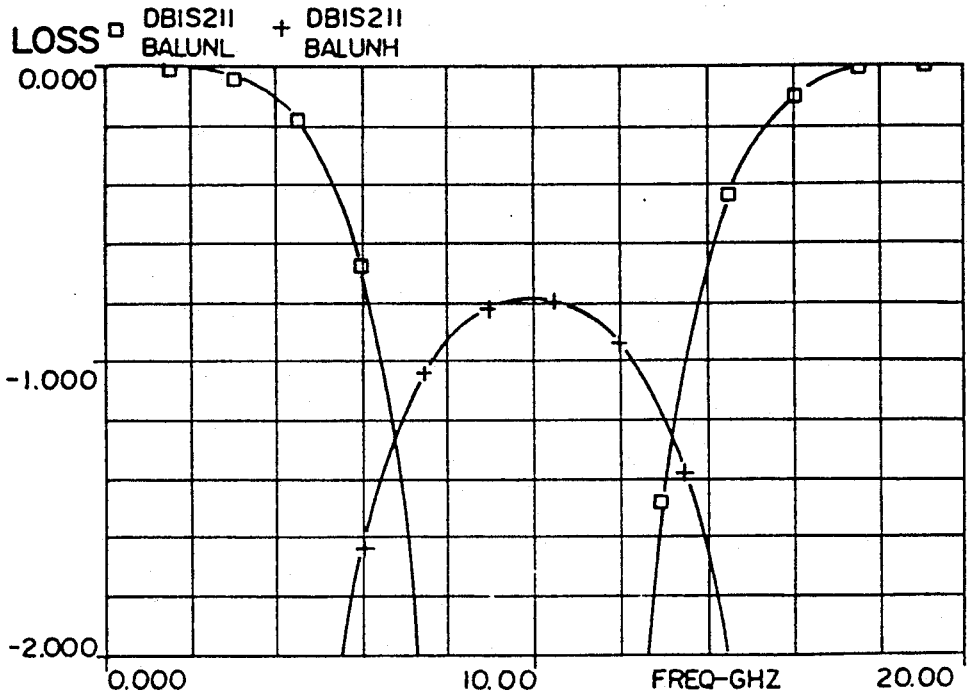
Figure 15B:
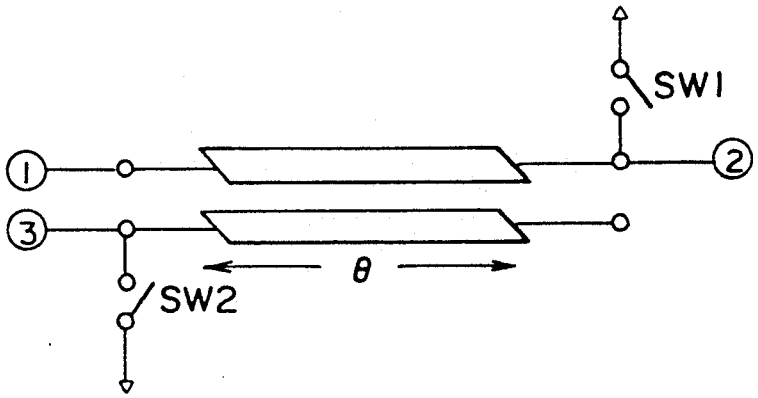

Simulation results of frequencies versus transmission characteristics of the above-described coupled line are shown in FIGS. 11A and 11B to FIGS. 15A and 15B. FIGS. 11A and 11B show transmission characteristics and an equivalent circuit under the conditions that the characteristic impedance of a signal circuit connected to a switch is set to be 50Ω, the odd-mode characteristic impedance $Z_{00}=25\Omega$, and the even-mode characteristic impedance $Z_{oe}=1{,}000\Omega$.

FIGS. 12A and 12B to FIGS. 15A and 15B show the same relationship as that of FIGS. 11A and 11B. In FIGS. 12A and 12B to FIGS. 15A and 15B, identical coupled lines are used, but switches are inserted in different positions. The position where the switches are inserted and the odd-mode and even-mode characteristic impedances of the coupled lines are shown in FIGS. 12A and 12B to FIGS. 15A and 15B.

More specifically, in the example shown in FIGS. 11A and 11B, the main transmission line has good transmission characteristics in all frequency ranges, and the coupled transmission line has good transmission characteristics in a band ranging from about 4 GHz to 16 GHz.

Note that the conditions described in the above simulations are necessary conditions for performing transmission with low losses in a band which is as wide as possible, and the values are different depending on the specifications of required signal selectors.

(Structure of Coupled Line)

Figure 16A:
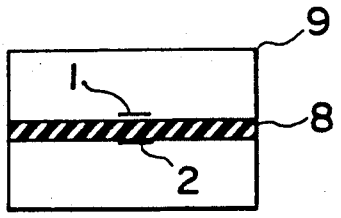
Figure 16B:
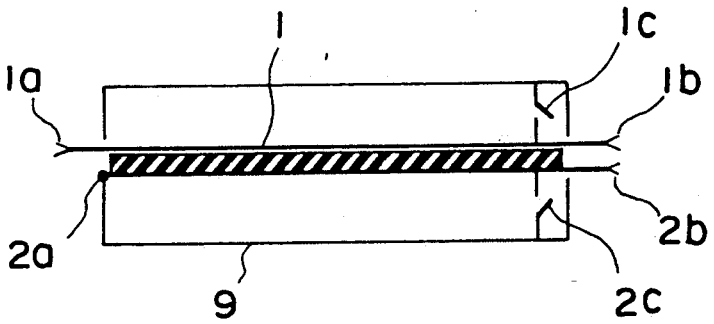
Figure 17:
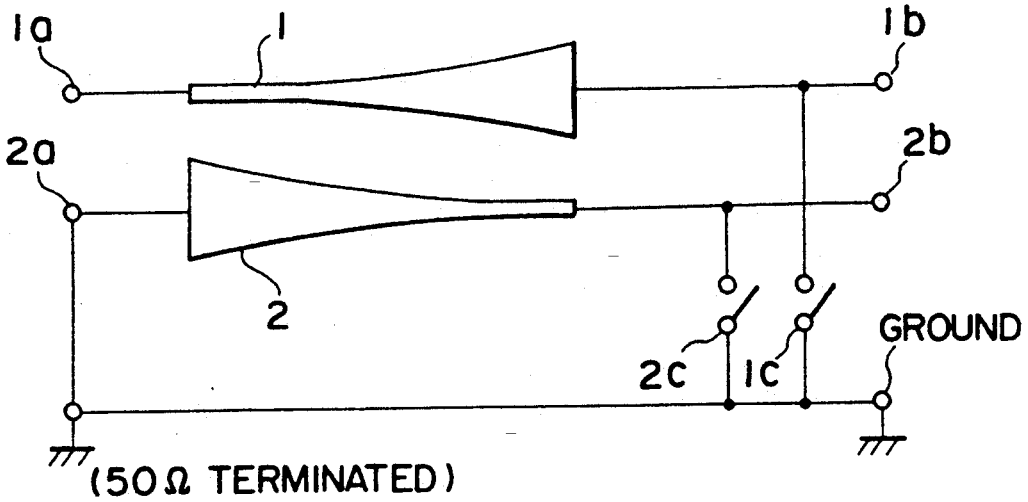
FIG. 17 is a view showing a tapered transmission line.

In addition to the coupled lines having the above structures, coupled lines shown in FIGS. 16A and 16B and FIG. 17 are known. FIG. 16A is a sectional view along a line perpendicular to the axis in the longitudinal direction of the transmission lines, and FIG. 16B is a sectional view along a line parallel to the axis. A main transmission line 1 is arranged on one surface of a support member 8 consisting of an insulator, and a coupled transmission line 2 is arranged on the other surface. One terminal 2*a* of the coupled transmission line 2 opposite to a common terminal 1*a* of the main transmission line 1 is connected to a case 9 serving as ground. A switch 1*c* is arranged between ground and a signal selecting terminal 1*b* serving as the other end of the transmission line 1, and a switch 2*c* is arranged between ground and a signal selecting terminal 2*b* serving as the other end of the transmission line 2.

FIG. 17 shows an arrangement of a coupled line having a tapered main transmission line and a tapered coupled transmission line. Other constituent elements and functions of the coupled line are the same as described above. The arrangement in FIG. 17 is especially suitable for the coupled line shown in FIGS. 16A and 16B.

Figure 18A:
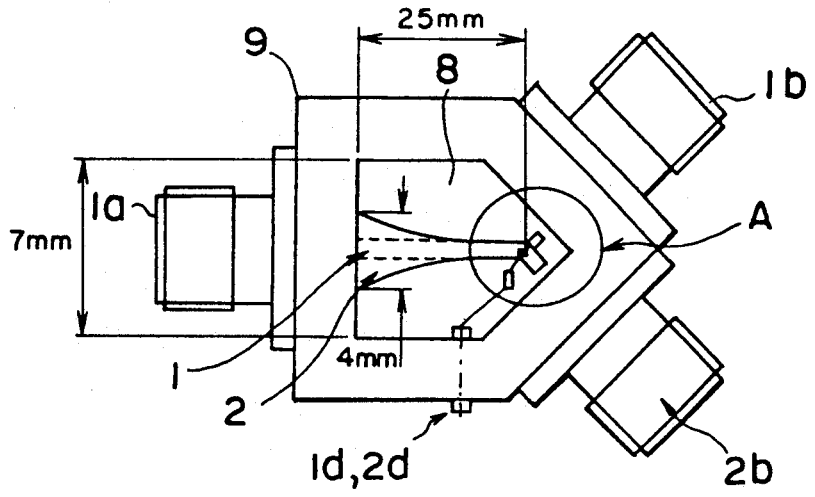
Figure 18B:
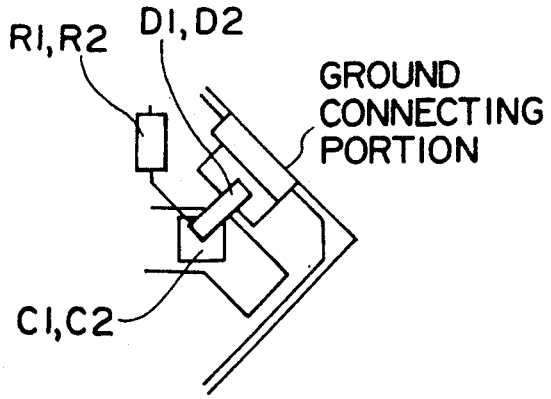
Figure 18C:
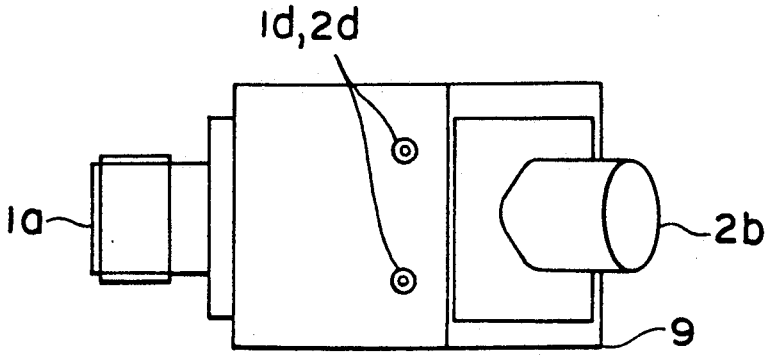
Figure 18D:
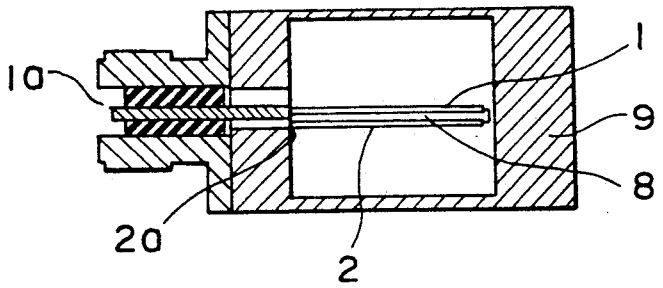
Figure 18E:
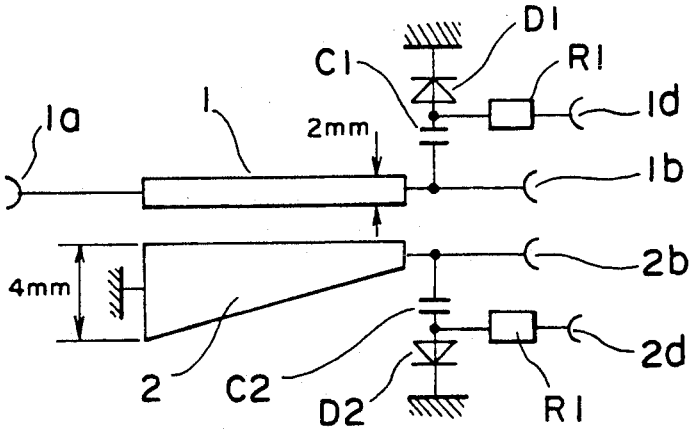

FIGS. 18A to 18D show the signal selector shown in FIGS. 16A and 16B in detail. FIG. 18A is a bottom view showing a signal selector in which SMA connectors are projected from a shield case 9 in a Y shape as a common terminal 1*a* and signal selecting terminals 1*b*and 2*b*, respectively, when the lower lid of the signal selector is removed. Inside the case 9, a flat type main transmission line 1 indicated by broken lines in FIG. 18A and a taper type coupled transmission line 2 are formed on the upper and lower surfaces of a support member 8 as strip lines (referring to the sectional view in FIG. 18D), respectively. As shown in FIG. 18B as an enlarged view of a portion surrounded by a circle A in FIG. 18A, capacitors C1 and C2, PIN diodes D1 and D2, and resistors R1 and R2 which are respectively connected between ground and the lines 1 and 2 are incorporated in the case 9 (referring to the wiring diagram in FIG. 18E). FIG. 18C is a side view. In FIG. 18C, a control bias terminal 1*d* connected to one end of the resistor R1 is projected from one side surface of the case 9, and the control bias terminal 2*d* connected to one end of the resistor R2 is projected from one side surface of the case 9.

A deformation bismaleimidetriazine resin (maximum width: 7 mm; thickness: 0.74 mm; and specific dielectric constant: 3.8) containing a glass fiber material is used as the support member 8. The main transmission line 1 is a flat type transmission line having a width of 2 mm and a length of 25 mm, and the coupled transmission line 2 is a taper type transmission line having a maximum width of 4 mm, a minimum width of 2 mm, and a length of 25 mm. Each of the capacitors C1 and C2 has a capacitance of 2,000 pF, and each of the resistors R1 and R2 has a resistance of 1 kΩ.

Figure 19A:
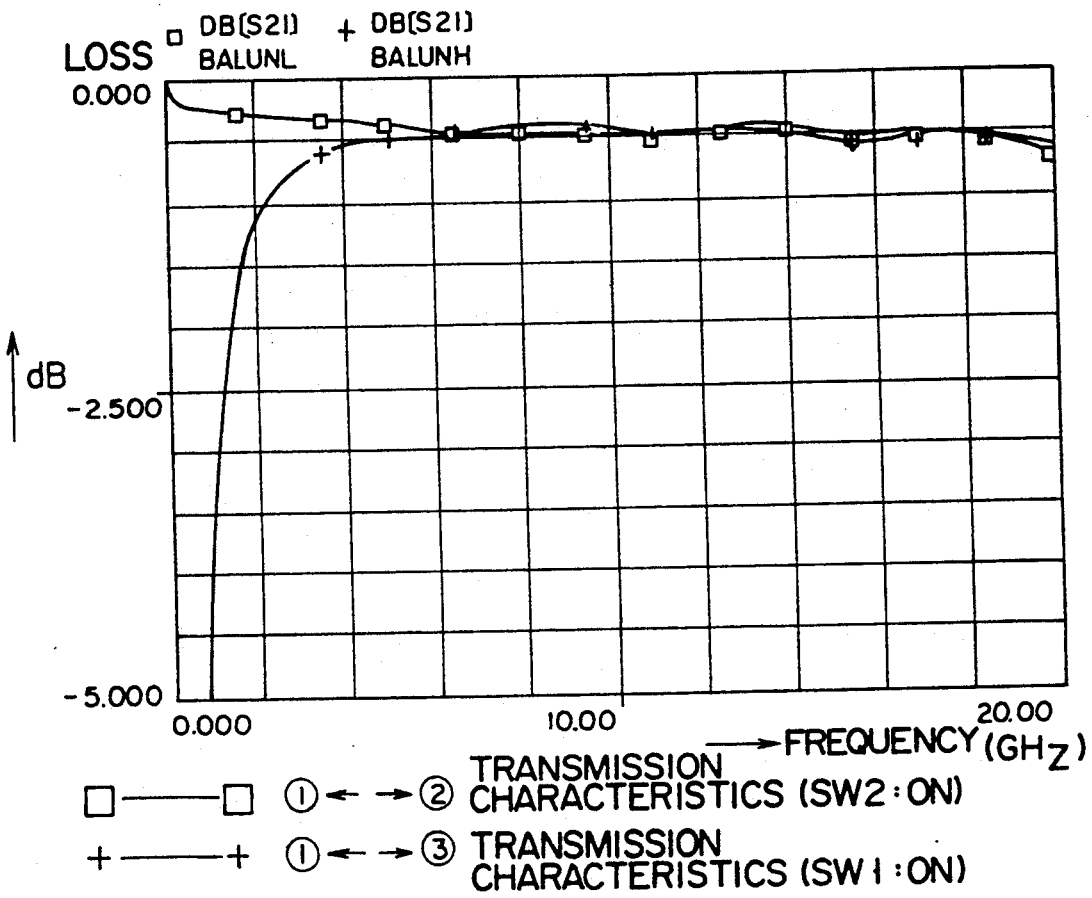
Figure 19B:
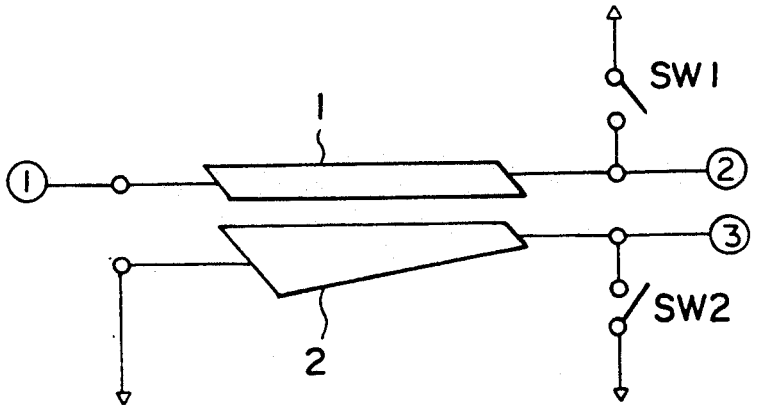

FIGS. 19A and 19B show the actually measured characteristics of a signal selector arranged under the above conditions and a conditional circuit under the conditions, respectively. More specifically, excellent transmission characteristics which support the results of the above simulation shown in FIGS. 11A and 11B can be obtained.

(Another Example Using Magnetic Coupling)

Another example using magnetic coupling is obtained as follows. For example, a bifilar winding delay line disclosed in a research and application report of Telecommunication Laboratory of Japan, Vol. 17, No. 12 (published in 1968) pp. 159 to 174 (basic study related to a wideband line type transformer) and (especially shown in FIG. 5 of p. 164) is used as an actual transmission line such that two insulating lines are twisted, and the stranded wire is wound around a magnetic member. According to this technique, when a large number of insulating lines are twisted, and stranded wires are wound around a magnetic member, a required multiwire line can be obtained.

A technique disclosed in "PROCEEDINGS OF THEIRE" 1959, August, pp. 1,337 to 1,342 (Some Broad-Band Transformers) can be used for a bifilar winding.

(Other Application Examples)

In the application example in FIG. 2, in general, one switch is turned off, and all the remaining switches are turned on, thereby obtaining a signal from a signal selecting terminal corresponding to the OFF switch. However, an application example in which all switches are turned on (no signal is supplied to all signal selecting ends) or an application example in which a plurality of switches are turned off (a signal is supplied to a plurality of signal selecting terminals at the same time: signal distribution) may be used. In this case, although faults such as a signal loss and impedance matching are caused, when the faults do not adversely affect a peripheral circuit, the above application examples can be used.

(Compensation of Capacitance of Switch)

Figure 20:
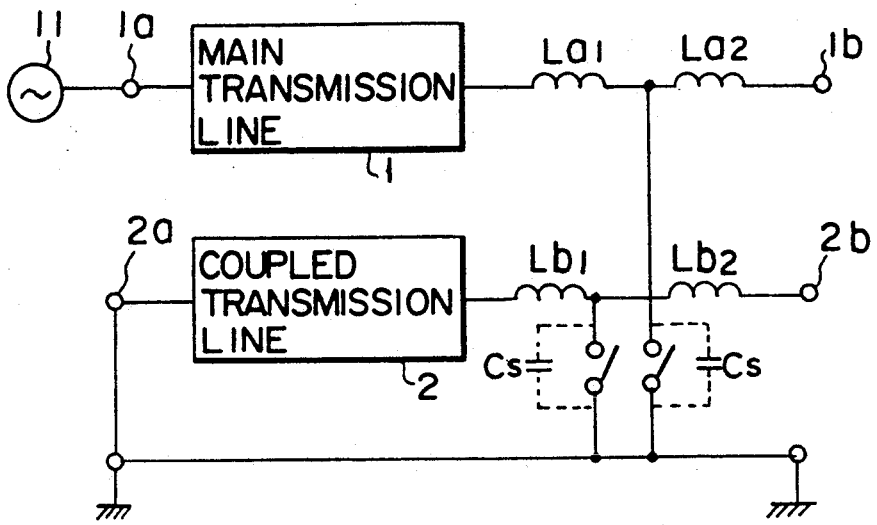
FIG. 20 is a view showing an arrangement of an example for correcting the stray capacitance of a switch.
Figure 21:
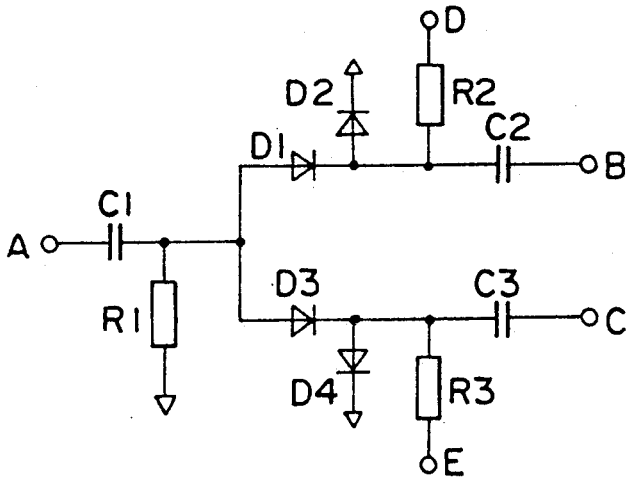
FIG. 21 PRIOR ART
FIG. 21 is a view showing an arrangement of a conventional signal selector.
Figure 22:
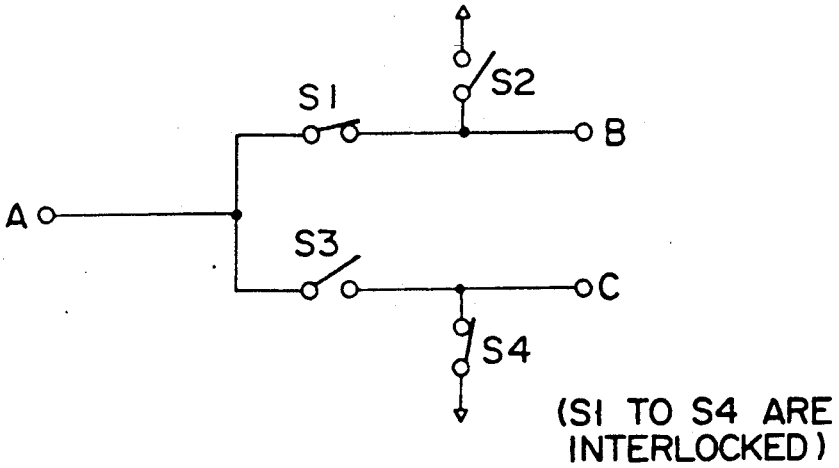
FIG. 22 PRIOR ART
FIG. 22 is a view showing an arrangement of the equivalent circuit in FIG. 20.

In each of the above embodiments, when a signal selector is used in a frequency range in which the stray capacitances (Cs) of switches are not negligible, as shown in FIG. 20, frequency characteristics can be improved by adding inductors $L_{a1}$, $L_{b1}$, $L_{a2}$, and $L_{b2}$. Note that the capacitances can be compensated by adding only the inductors $L_{a1}$ and $L_{b1}$ or the inductors $L_{a2}$ and $L_{b2}$.

(Effect of the Invention)

According to the present invention, a coupled line constituted by a main transmission line and one or a plurality of coupled transmission lines coupled to the main transmission line by an electric field, a magnetic field, or both the electric and magnetic fields is arranged, and a plurality of conducting means which can be opened is arranged between one end of a desired transmission line and ground. Therefore, the present invention has the following effects:

(1) Any signal distortion does not occur because no nonlinear element is interposed in a path through which a signal passes.

(2) A signal having a DC band can be transmitted because no DC blocking capacitor is interposed in series in a main transmission line.

(Industrial Applicability)

A signal selector according to the present invention can be generally applied to a signal switch in a wideband ranging from a DC band to a microwave band and, more particularly, can be applied to equipment in many fields, such as a wideband spectrum analyzer and a signal generator.

What is claimed is:

1. A signal selector comprising:

a main transmission line having a transmission characteristic in a bandwidth ranging from a DC band to a high-frequency band, said main transmission line having one end connected to a common terminal to which a signal to be selectively transmitted is input, and another end connected to a first signal selecting terminal from which said signal to be selectively transmitted is output;

at least one coupled transmission line coupled with said main transmission line through at least one of an electric field and a magnetic field, such that said at least one coupled transmission line and said main transmission line constitute a distributed coupled line, said at least one coupled transmission line having a transmission characteristic in a high-frequency bandwidth, said at least one coupled transmission line having one end connected to ground, and another end connected to at least one second signal selecting terminal from which a signal to be selectively transmitted and which is induced from said main transmission lie to said at least one coupled transmission line, is output;

first conducting means connected between said first signal selecting terminal and said ground so that a connecting state between said first signal selecting terminal and said ground is selected between an open state and a closed state; and at least one second conducting means connected between said at lest one second signal selecting terminal and said ground so that a connecting state is selected between an open state and a closed state; and said signal selector enabling a signal, which has said transmission characteristic in the bandwidth ranging from the DC band to the high-frequency band, to be output form said first signal selecting terminal as said signal to be selectively transmitted when said first conducting means is in the open state and said at least one second conducting means is in the closed state, and enabling a signal, which has said transmission characteristic in the high-frequency band, to be output from said at least one second signal selecting terminal as said signal, which is induced on said at least one coupled transmission line, to be selectively transmitted when said first conducting means is in the closed state and said at least one second conducting means is in the open state.

2. A signal selector according to claim 1, wherein said first conducting means comprises:

a capacitor having one end connected to said first signal selecting terminal, and another end;

a PIN diode having one end connected to said ground and another end connected to said another end of said capacitor; and a resistor having one end connected between a contact point of said capacitor and said PIN diode, and a bias voltage terminal.

3. A signal selector according to claim 1, wherein said at least one second conducting means comprises:

a capacitor having one end connected to said at least one second signal selecting terminal, and another end;

a PIN diode having one end connected to said ground and another end connected to said another end of said capacitor; and a resistor having one end connected between a contact point of said capacitor and said PIN diode, and a bias voltage terminal.

4. A signal selector according to claim 1, wherein said at least one second signal selecting terminal is arranged so as to oppose said first signal selecting terminal.

5. A signal selector according to claim 1, wherein said at least one second signal selecting terminal is arranged so as to oppose said common terminal.

6. A signal selector according to claim 1, wherein sad main transmission line is coupled to said at least one coupled transmission line by magnetic coupling using a transformer.

7. A signal selector according to claim 1, wherein said main transmission line is coupled to said at least one coupled transmission line by electric field coupling using a capacitor.

8. A signal selector according to claim 7, wherein said capacitor includes a dielectric substrate and a pair of strip lines formed an opposite faces of said dielectric substrate, one said strip line being provided as said main transmission line and the other said strip line being provided as said at least one coupled transmission line.

9. A signal selector according to claim 8, wherein:

said one end of said main transmission line is connected to a first connector as said common terminal, said another end of said main transmission line is connected to a second connector as said first signal selecting terminal, said one end of said at least one coupled transmission line is connected to a third connector as said at least one second signal selecting terminal, and said first to third connectors are projected in a Y shape from a shield case for incorporating said dielectric substrate and said pair of strip lines.

* * * * *